US008181820B2

(12) United States Patent
Takeda

(10) Patent No.: US 8,181,820 B2
(45) Date of Patent: May 22, 2012

(54) MECHANISM FOR OPENING AND CLOSING AN OPENING PORTION

(75) Inventor: Shiro Takeda, Aki-gun (JP)

(73) Assignee: Takeda Brush Inc., Aki-Gun, Hiroshima (JP)

( * ) Notice: Subject to any disclaimer, the term of this patent is extended or adjusted under 35 U.S.C. 154(b) by 0 days.

(21) Appl. No.: 12/597,242

(22) PCT Filed: Jan. 14, 2009

(86) PCT No.: PCT/JP2009/050352
§ 371 (c)(1),
(2), (4) Date: Feb. 23, 2010

(87) PCT Pub. No.: WO2009/101832
PCT Pub. Date: Aug. 20, 2009

(65) Prior Publication Data

US 2010/0314392 A1 Dec. 16, 2010

(30) Foreign Application Priority Data

Feb. 13, 2008 (JP) ..... 2008-031302

(51) Int. Cl.
*B65D 43/16* (2006.01)
*B65D 43/26* (2006.01)

(52) U.S. Cl. ..... 220/810; 220/263; 220/832

(58) Field of Classification Search ..... 220/810, 220/263, 832, 836, 260
See application file for complete search history.

(56) References Cited

U.S. PATENT DOCUMENTS 5,647,498 A * 7/1997 Kaneko ..... 220/263

(Continued)

FOREIGN PATENT DOCUMENTS

| | | | |
|---|---|---|---|
| EP | 1 269 883 | A1 | 1/2003 |
| JP | 60-126111 | U | 8/1985 |
| JP | 62-073807 | U | 5/1987 |
| JP | 2004-024716 | A | 1/2004 |
| JP | 3696437 | B2 | 9/2005 |
| JP | 3806838 | B2 | 8/2006 |

OTHER PUBLICATIONS

International Search Report (PCT/ISA/210) for PCT/JP2009/050352 mailed Apr. 14, 2009.

*Primary Examiner* — Mickey Yu
*Assistant Examiner* — Niki Eloshway
(74) *Attorney, Agent, or Firm* — Buchanan Ingersoll & Rooney PC

(57) ABSTRACT

A mechanism for opening and closing an opening portion is disclosed. The mechanism can simply and reliably open and close the opening portion without requiring a spring but using a simple mechanism and can stably maintain the closed state of the opening portion. When the opening portion is closed by a lid, with the head end side of the opening and closing member being protruded from the opening portion, the head end of the opening and closing member makes contact with the surface of the lid which faces the inner side of the opening portion, causing the lid to rotate about one end thereof which is rotatably supported by a rotation supporting shaft. This changes the state of the opening portion from the closed state to the opened state. When the head of the opening and closing member retracts into the opening portion from the state in which the opening and closing member is protruded from the opening portion, the protrusion of the opening and closing member will be made to engage the head end of a wound section of the lid, causing the lid to rotate about the one end of thereof which is rotatably supported by the rotation supporting shaft. This changes the state of the opening portion from the opened state to the closed state.

1 Claim, 3 Drawing Sheets

U.S. PATENT DOCUMENTS

| | | | | |
|---|---|---|---|---|
| 6,293,719 | B1 * | 9/2001 | Ohba | 401/59 |
| 6,446,307 | B2 * | 9/2002 | Wilkins | 16/325 |
| 7,559,433 | B2 * | 7/2009 | Yang et al. | 220/832 |
| 7,604,142 | B2 * | 10/2009 | Banik | 220/4.22 |
| 7,748,556 | B2 * | 7/2010 | Yang et al. | 220/263 |
| 2003/0145872 | A1 | 8/2003 | Takeda | |
| 2007/0246060 | A1 * | 10/2007 | Yuhara et al. | 132/294 |
| 2008/0179323 | A1 * | 7/2008 | Circosta et al. | 220/8 |
| 2009/0097899 | A1 * | 4/2009 | Carroll | 401/109 |
| 2010/0307530 | A1 * | 12/2010 | Bennett | 132/307 |

* cited by examiner

MECHANISM FOR OPENING AND CLOSING AN OPENING PORTION

BACKGROUND

1. Technical Field

The present invention relates to a mechanism for opening and closing an opening portion. More particularly, the present invention relates to the construction of the mechanism for opening and closing the opening portion that includes an outer frame having an opening portion formed therein and that may be opened and closed by a lid member, and an internal member that is provided inside the outer frame and may be operated so that it can be made to slide out of and into the opening portion.

2. Description of the Prior Art

In the mechanism for opening and closing the opening portion according to the prior art, it is general that the opening portion is opened and closed by the lid member that is mounted by means of the hinge or pair of male and female screws to the body having the opening portion formed therein, and the opening portion and closing operations are performed by using any elastic element such as the spring (for example, see Japanese utility model application now opened for public examination under No. S62 (1987)-073807).

SUMMARY OF THE INVENTION

The mechanism for opening and closing the opening portion according to the prior art described above have several problems that will be described below. That is, one problem is that some amount of power is required when the lid member is to be closed, because the spring is used for opening and closing the opening portion. Another problem is that the number of component parts must be increased, which increases the manufacturing costs accordingly. Still another problem is that, in most cases, both hands must be used when the lid member is to be opened and closed. One hand operation is thus difficult.

In light of the problems listed above, therefore, one object of the present invention is to improve the conventional mechanism for opening and closing the opening portion of the type which is known to the prior art, such as the one as described above, thereby providing a novel mechanism for opening and closing the opening portion having the construction that is simplified by eliminating any type of elastic element such as the spring and reducing the number of component parts, allowing the opening portion and closing operation to be performed easily and reliably, while at the same time allowing the closed state to be maintained with high stability once the opening portion is closed.

In order to accomplish the above object, the mechanism for opening and closing the opening portion that is proposed in accordance with the present invention is constructed as described below.

In the mechanism for opening and closing the opening portion according to the present invention, an opening portion is formed by the outer wall member on the outer frame, and the opening portion may be opened and closed by the lid member.

In accordance with the mechanism for opening and closing the opening portion, a rotation supporting shaft is disposed on the outer side of an end that faces the opening portion formed by the outer wall member.

On one end side of the lid member, the wound section of the lid member that is to be wound around the rotation supporting shaft is provided, and the wound section of the lid member may be provided for surrounding the rotation supporting shaft so that one end of the lid member can be supported pivotally by the rotation supporting shaft and the opening portion can be closed by the other end side of the lid member.

The opening and closing operation of the opening portion by the lid member may be performed by operating the opening and closing member so that its head end can be made to slide out of and into the opening portion inside the outer wall member on the outer frame.

The head end of the lid member's wound section surrounding the rotation supporting shaft is provided for extending inwardly of the opening portion formed by the outer wall member on the outer frame until it reaches the point closer to the inward direction of the opening portion than the point where the central axis of the rotation supporting shaft is located when the opening portion is closed by the lid member.

In addition, the opening and closing member has a hooked portion on the outer wall thereof on the side facing opposite the outer frame on which the head end is made to slide out of and into the opening portion, the hooked portion having a head end directed from the inner side toward the outer side of the outer wall member on the outer frame.

With the opening portion being closed by the lid member, the head end of the wound section of the lid member and the head end of the hooked portion are brought closer to each other so that they can face opposite each other.

The operation of the mechanism for opening and closing the opening portion having the construction that has been described above is now described. In describing the operation, it is supposed that the opening portion is now closed by the lid member. Then, the opening and closing member may be operated so that its head end side can be made to slide out of the opening portion that is now placed in its closed state. As the head end is sliding out of the opening portion, it will be made to engage the side of the lid member that is directed inwardly of the opening portion, causing the lid member to rotate about one end thereof that is supported pivotally by the rotation supporting shaft. This will place the opening portion in its opened state. When the opening portion which is now opened as described above is to be brought back into its closed state, the opening and closing member may be operated so that its head end can be made to slide into the opening portion from the state in which the head end is now placed out of the opening portion. As the head end is sliding back into the opening portion, it will cause the hooked portion of the opening and closing member to engage the head end of the lid member's wound section. This will cause the lid member to rotate about one end thereof that is supported pivotally by the rotation supporting shaft. This will place the opening portion in its closed state.

It may be appreciated from the foregoing description that the mechanism for opening and closing the opening portion in accordance with the present invention has the simplified construction including the reduced number of component parts without the need of using the spring element in particular. The opening portion can thus be opened and closed with ease and with high reliability. As the opening portion is closed, it can be maintained in its closed state with high stability.

BEST MODE OF EMBODYING THE INVENTION

A preferred embodiment of the present invention is now described below by referring to the accompanying drawings.

Figure 1:
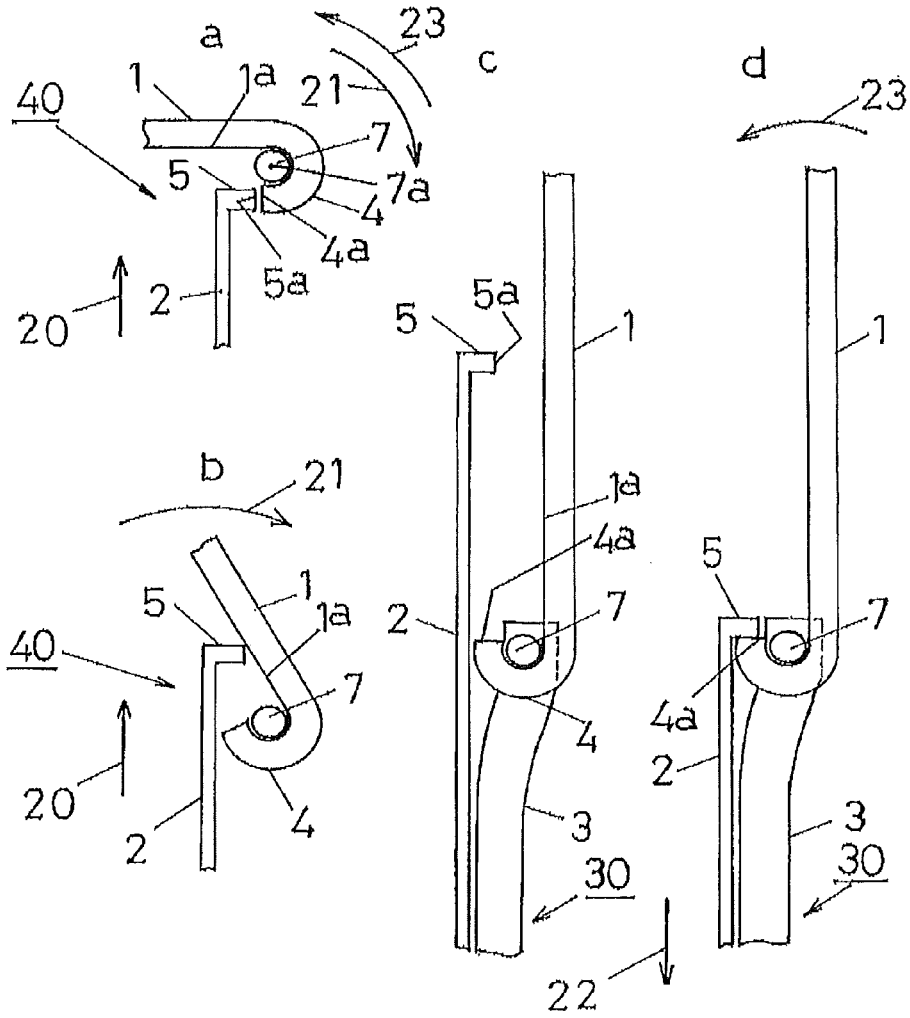
FIG. 1 is a side view illustrating the mechanism for opening and closing the opening portion in accordance with one embodiment of the present invention, in which (a) is a side view showing the state in which the opening portion is now closed although some non-essential parts are not shown; (b) is a side view showing the state in which the opening portion is initially to be opened from the closed state shown in FIG. 1 (*a*) by beginning to rotate the lid member although some non-essential parts are not shown; (c) is a side view showing the state in which the opening portion is being opened further from the state shown in FIG. 1 (*b*) and has now been opened completely although some non-essential parts are not shown; and (d) is a side view showing the state in which the opening portion is in the process of being closed from the state shown in FIG. 1 (*c*) by rotating the lid member although some non-essential parts are not shown.
Figure 2:
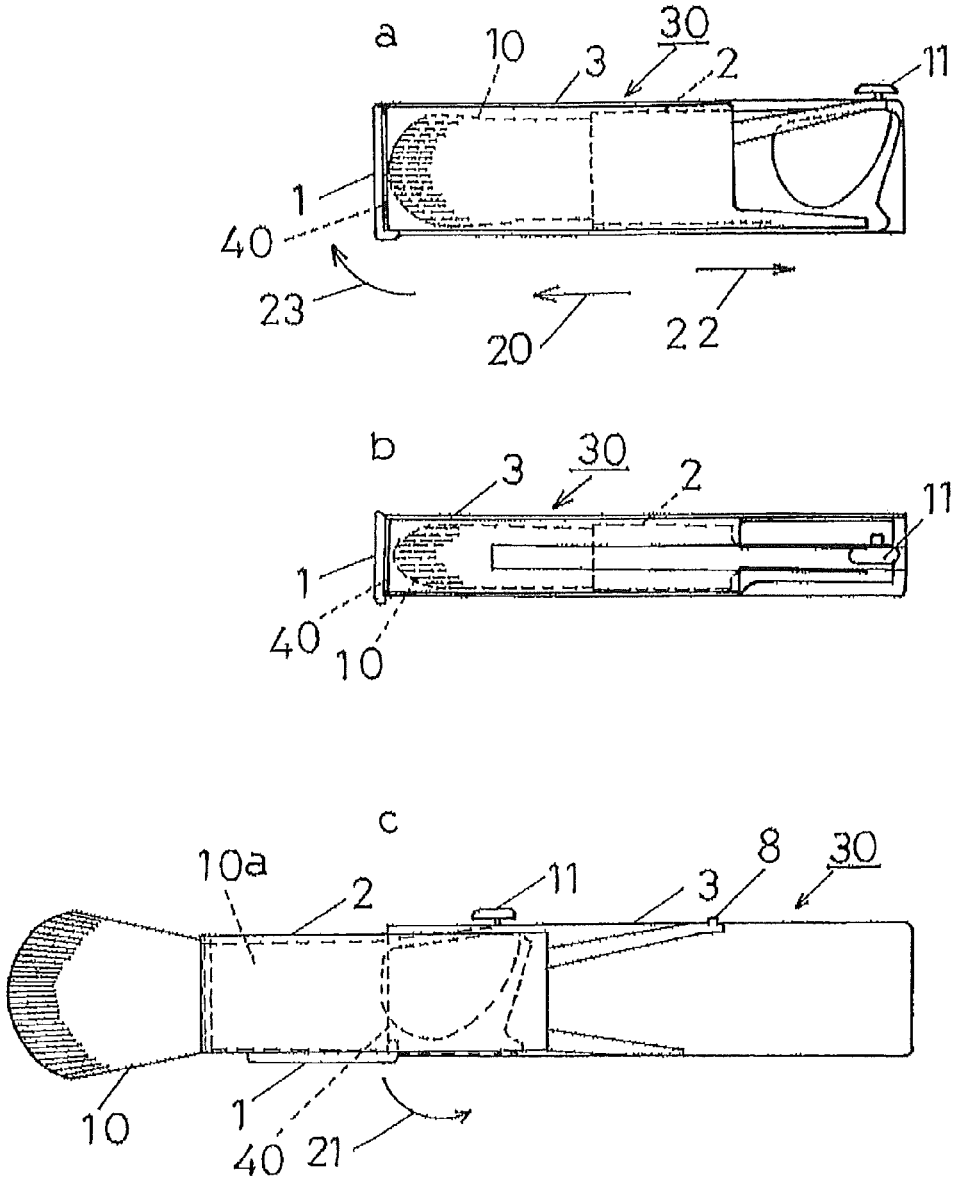
FIG. 2 is a diagram illustrating one example of the application in which the mechanism for opening and closing the opening portion according to the present invention is implemented as a commercial article such as a makeup brush device, in which (a) is a side elevation view of the makeup brush device; (b) is a front view of the makeup brush device; (c) is a side elevation view showing the state in which the brush portion has been moved out of the makeup brush device, and is then used as the makeup brush.
Figure 3:
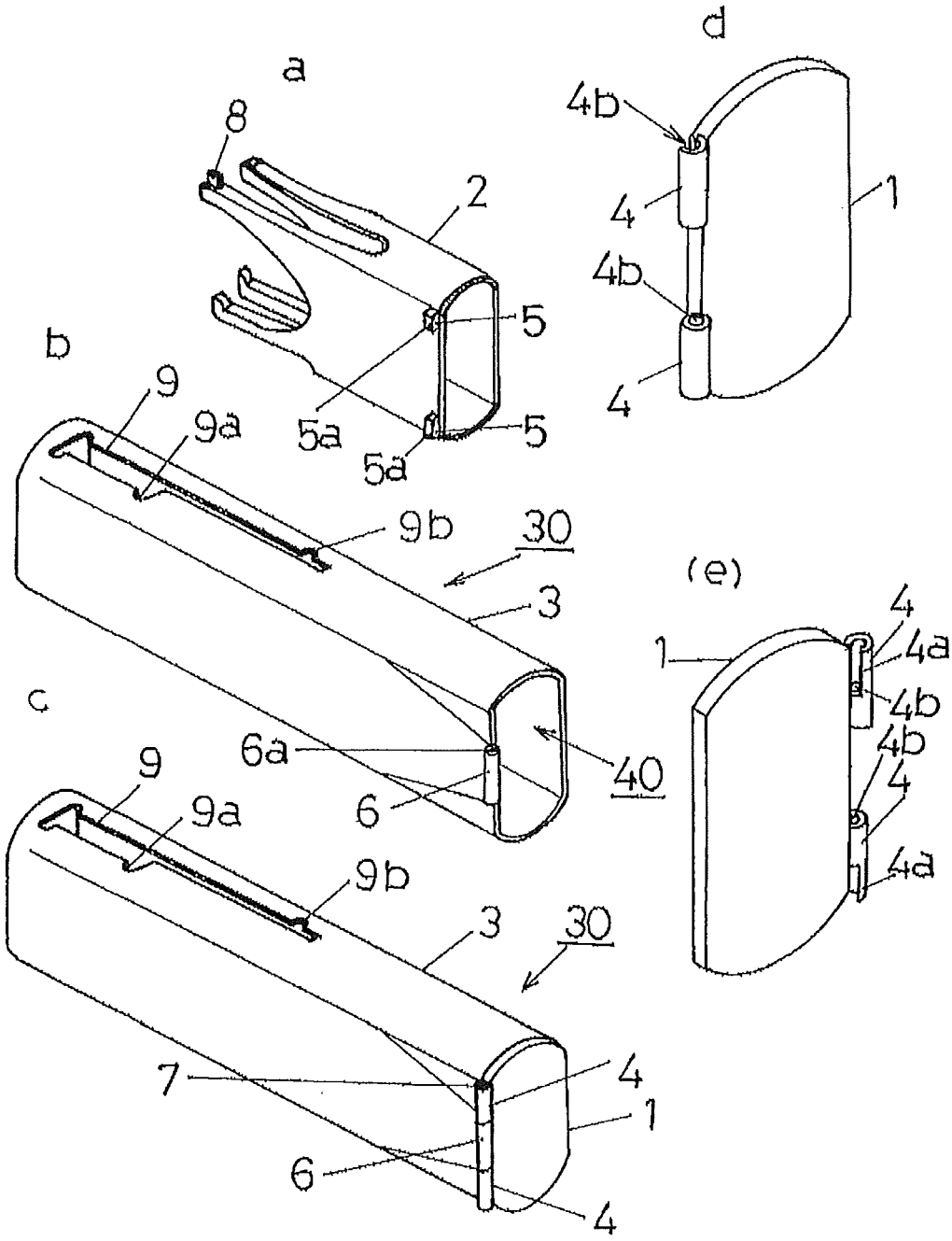
FIG. 3 is an exploded schematic perspective view illustrating the individual component parts that constitute the makeup brush device shown in FIG. 2, in which (a) is a perspective view of a hollow cylindrical body that is functionally equivalent to the opening and closing member; (b) is a perspective view of the hollow cylindrical body showing the state in which the lid member is not mounted to the opening portion formed in the outer frame; (c) is a perspective view of the hollow cylindrical body showing the state in which the lid member is mounted to the opening portion formed in the outer frame; (d) is a perspective view of the hollow cylindrical body showing the front side of the lid member on an enlarged scale; and (e) is a perspective view of the hollow cylindrical body showing the rear side of the lid member on an enlarged scale.

Referring now to FIGS. 1, 2 and 3, one example of the mechanism for opening and closing the opening portion according to the present invention is shown, in which an opening portion 40 is formed by an outer wall member 3 on an outer frame 30, and the opening portion 40 may be opened and closed by a lid member 1.

In the mechanism for opening and closing the opening portion, a rotation supporting shaft 7 is disposed on the outer side of the end facing the opening portion 40 on the outer wall member 3 as shown in FIG. 1 (*a*) through FIG. 1 (*d*).

In the embodiment shown in FIG. 3, for example, a supporting cylindrical portion 6 having a central hole 6*a* is formed on the outer side of the end facing the opening portion 40 on the outer wall member 3, and the rotation supporting shaft 7 may be mounted into the hole 6*a*.

On one end side of the lid member 1 (on the right end side in FIG. 1 (*a*)), the lid member 1 has a wound section 4 that may be wound around the rotation supporting shaft 7.

The wound section 4 on the lid member 4 is wound around the rotation supporting shaft 7 as shown in FIG. 1 so that one end of the lid member 1 (on the right side in FIG. 1 (*a*)) can be supported pivotally by the rotation supporting shaft 7, with the other end of the lid member 1 (on the left side in FIG. 1 (*a*) and on the upper side in FIGS. 1 (*c*) and (*d*) closing the opening portion 40.

The opening and closing operation of the opening portion 40 by the lid member 1 may be performed by an opening and closing member 2. Specifically, the opening and closing member 2 includes a head end (on the upper side in FIGS. 1 (*a*) through (*d*)) that may be made to slide out of and back into the opening portion 40 inside the outer wall member 3 on the outer frame 30 having the opening portion 40 formed therein (on the left side of the outer wall member 3 in FIGS. 1 (*c*) and (*d*)). Thus, the opening portion 40 may be opened and closed by causing the head end of the opening and closing member 2 to be protruded and retracted slidably.

The opening and closing member 2 includes a hooked portion 5 that is provided on the outer wall thereof on the side on which the head end faces opposite the outer frame 30. The hooked portion 5 has a forward end 5*a* that is provided so as to extend from the inner side of the outer wall member 3 on the outer frame 30 toward the outer side (from the left side toward the right side in FIG. 1 (*a*)).

As the opening portion 40 formed by the outer wall member 3 on the outer frame 30 is closed by the lid member 1, on the other hand, the head end of the lid member's wound section 4 that is wound around the rotation supporting shaft 7 is provided for extending inwardly of the opening portion 40 (from the right side toward the left side in FIG. 1 (*a*)) until it reaches the point closer to the inward direction than the point in which the central axis 7*a* of the rotation supporting shaft 7 is located.

With the opening portion 40 being closed by the lid member 1 as shown in FIG. 1 (*a*), the head end 4*a* of the lid member's wound section 4 and the head end 5*a* of the hooked portion 5 of the opening and closing member 2 may be located closer to each other so that they can face opposite each other.

With the opening portion 40 being closed by the lid member 1 as shown in FIG. 1 (*a*), therefore, even if any attempt should be made to open the opening portion 40 by rotating the lid member 1 in the direction of an arrow 21 (FIG. 1 (*a*)) about the one end of the lid member 1 (the right end in FIG. 1 (*a*)) supported pivotally by the rotation supporting shaft 7 with the left end of the lid member 1 (not shown) being held by one hand, the opening portion 40 will never be opened because the head end 4*a* of the lid member's wound section 4 is made to engage the head end 5*a* of the hooked portion 5 of the lid member 1, which prevents the lid member 1 from being rotated in the direction of the arrow 21.

When the opening and closing member 2 is moved from the state in which the opening portion 40 is now closed toward the direction of an arrow 20 (FIGS. 1 (*a*), (*b*)), the head end of the opening and closing member 2 will be slid out of the opening portion 40, causing the head end of the opening and closing member 2 (the upper end in FIGS. 1 (*a*), (*b*)) to engage the surface la directed inwardly of the opening portion 40 of the lid member 1.

This will cause the lid member 1 to rotate about the one end thereof (the right end in FIG. 1 (*a*)) supported pivotally by the rotation supporting shaft 7, permitting the opening portion 40 to be opened as shown in FIG. 1 (*c*), (*d*) from the closed state.

As the head end 4*a* of the lid member's wound section 4 is then rotated from the state shown in FIG. 1 (*a*) to the stated shown in FIG. 1 (*b*), it will be placed in the state shown in FIG. 1 (*c*). This is because, with the opening portion 40 being closed by the lid member 1 as shown in FIG. 1 (*a*), as described earlier, the head end 41 of the lid member's wound section 4 that is wound around the rotation supporting shaft 7 is extended inwardly of the opening portion 40 formed by the outer wall member 3 on the outer frame (from the right side toward the left side in FIG. 1 (*a*)) until it reaches the point that is located closer to the inward direction of the opening portion 40 than the point in which the central axis 7*a* of the rotation supporting shaft 7 is located.

When the opening and closing member 2 is then moved in the direction of an arrow 22 (FIG. 1 (*d*)) so that the head end side of the opening and closing member 2 (the upper side in FIGS. 1 (*a*) through (*d*)) can be retracted from the state in which the opening portion 40 is protruded as shown in FIGS. 1 (*b*), (*c*), (*d*)), the hooked portion 5 of the opening and closing member 2 will be made to engage the head end 4*a* of the lid member's wound section 4.

When the opening and closing member 2 is then further moved in the direction of an arrow 22 (FIG. 1 (*d*)), causing its head member to be retracted into the opening portion 40, the lid member 1 will be rotated as indicated by an arrow 23 about the one end thereof (FIG. 1 (*a*)) supported pivotally by the rotation supporting shaft 7. Then, this will cause the lid member 1 to be rotated from the opened state of the opening portion 40 shown in FIGS. 1 (*c*), (*d*) toward the closed state shown in FIG. 1 (*a*), causing the opening portion 40 to be closed by the lid member 1 as shown in FIG. 1 (*a*).

It may be appreciated from the foregoing description that the mechanism for opening and closing the opening portion according to the present invention can have the simplified construction that includes the reduced number of component parts in which the opening portion 40 can be opened and closed easily and reliably, and the opening portion 40 can be maintained in the closed state (FIG. 1 (*a*)) stably once it is closed.

As one example of its application, the mechanism for opening and closing the opening portion that has been described so far by referring to FIG. 1 may be implemented as a makeup brush device as shown in FIGS. 2 and 3.

In this example, the makeup brush device includes the outer wall member 3 on the outer frame 30 in which the opening portion 40 is formed, and the lid member 1 that may be operated to open and close the opening portion 40. Inside the outer wall member 3, a hollow cylindrical body (which is functionally equivalent to the opening and closing member 2) is disposed in such a manner that it may be made to slide out of and into the opening portion 40 inside the outer wall member 3. In addition, inside the hollow cylindrical body (which is functionally equivalent to the opening and closing member 2), there is a brush holding portion 10*a* for holding a brush 10 at its head end and which may be made to slide out of and into the opening portion of the hollow cylindrical body slidably.

When the makeup brush device is not in use, the head end of the brush portion 10 may be made to slide back into the opening portion 40 formed by the outer wall member 3 on the outer frame 30 as shown in Figs. (a), (b), and the opening portion 40 may then be closed by the lid member 1. When the makeup brush device is in use, on the other hand, the brush part 10 may be made to slide out of the opening portion 40 as shown in FIG. 2 (*c*).

In FIGS. 2 and 3, the component parts that are similar to those shown and described in FIG. 1 are given similar reference numerals, and the description of those similar component parts is omitted here to avoid the duplicate description.

On the outer side of the end of the outer wall member 10 on the outer frame 30 that faces the opening portion 40, a cylindrical supporting part 6 is provided as shown in FIG. 3 (*b*). On one end of the lid member 1 for opening and closing the opening portion 40, the lid member's wound sections 4, 4 are disposed, and the lid member 1 is mounted to the end of the outer wall member 3 that faces the opening portion 40 as shown in FIG. 3 (*c*). The rotation supporting shaft 7 is provided on the outer side of the end of the outer wall member 3 that faces the opening portion 40 in such a manner that it is inserted into the holes 4*b*, 4*b* provided in the lid member's wound sections 4, 4 and into the central hole 6*a* in the cylindrical supporting part 6.

A brush holder 10*a* for holding a brush portion 10 is provided inside the hollow cylindrical body that constitutes the opening and closing member 2.

An engaging protrusion 8 is formed on the upper side of the elastic rear end of the hollow cylindrical body forming the opening and closing member 2.

A protrusion 11 formed on the upper side of the elastic rear end of the brush holder 10*a* extends upwardly through a groove 9 formed on the outer wall member 3 on the outer frame 30 as shown in FIG. 2. When the protrusion 11 is pushed so that it can be moving in the direction of an arrow 20 in FIG. 2, the brush holder 10*a* and the hollow cylindrical body forming the opening and closing member 2 will be moved in the direction of the arrow 20. This will cause the head end of the hollow cylindrical body forming the opening and closing member 2 to engage the inner side of the lid member 1, which in turn will cause the lid member 1 to rotate in the direction of an arrow 21. Thus, the opening portion will be opened.

When the protrusion 11 is pushed further so that it can be moving in the direction of the arrow 20 in FIG. 2, the engaging protrusion 8 formed on the upper side of the elastic rear end of the hollow cylindrical body forming the opening and closing member 2 will be made to engage the engaging groove 9*a* formed on the groove 9. This will cause the protrusion 11 to stop moving any further, and will only enable the brush holder 10*a* to move in the direction of the arrow 20. Finally, the protrusion 11 will be made to engage the engaging groove 9*b* formed on the groove 9. This state is shown in FIG. 2 (*c*).

After the makeup brush device has been used when its brush portion 10 is placed in the state shown in FIG. 2 (*c*), the protrusion 11 and the engaging groove 9*b* may be disengaged from each other. Then, the protrusion 11 may be moved in the direction of the arrow 22 by pressing it, causing the head end of the brush portion 10 (the left end in FIG. 2 (*c*)) to be moved into the opening of the hollow cylindrical body forming the opening and closing member 2. Thus, the engaging protraction 8 and the engaging groove 9*a* may be disengaged from each other, permitting the hollow cylindrical body forming the opening and closing member 2 and the brush holder 10*a* to move in the direction of the arrow 22. Then, the protrusions 5, 5 formed on the hollow cylindrical body forming the opening and closing member 2 may be made to engage the head ends 4*a*, 4*a* of the lid member's wound sections 4, 4, causing the opening and closing member 2 to be moved further in the direction of the arrow 22 so that it can be slid into the opening portion 40. This may cause the lid member 1 to rotate about the one end (the lower end in FIGS. 2 (*a*), (*b*)) of the lid member 1 supported pivotally by the rotation supporting shaft 7 in the direction of the arrow 23. Thus, the opening portion 40 may be closed by the lid member 1 as shown in FIGS. 2 (*a*), (*b*).

When the opening portion 40 is placed in the state shown in FIGS. 2 (*a*), (*b*), as described previously, the head ends 4*a*, 4*a* of the lid member's wound sections 4, 4 and the head ends 5*a*, 5*a* of the protrusions 5, 5 of the opening and closing member 2 are brought closer to each other so that they can face opposite each other. Therefore, any attempt to open the opening portion 40 by holding the upper end of the lid member 1 (the lower end in FIG. 2 (*a*)) and then rotating the lid member 1 in the direction of the arrow 21 (FIG. 2 (*c*)) about the one end of the lid member 1 supported pivotally by the rotation supporting shaft 7 would fail since the head end 4*a* of the lid member's wound section 4 is then made to engage the head end 5*a* of the protrusion 5 of the opening and closing member 1, preventing the lid member 1 from being rotated in the direction of the arrow 21. Thus, the opening portion will never be opened in any way.

It may be appreciated from the foregoing description that the mechanism for opening and closing the opening portion in accordance with the present invention has the simplified construction that includes the reduced number of component parts and in which there is no need of using the spring or similar elements. Thus, the opening and closing operations of the opening portion 40 by the lid member can be performed by simply causing the brush holder 10*a* for holding the brush portion 10 at the head end thereof and the hollow cylindrical body (functionally equivalent to the opening and closing member 2) disposed inside the outer wall member 3 to slide out of and into the opening portion 40. The opening portion 40 that is thus closed by the lid member 1 can be maintained to be closed with stability.

Thus, the user can open and close the opening portion 40 by simply pushing and moving the protrusion 11 with one hand.

It may be appreciated from the foregoing description that the mechanism for opening and closing the opening portion according to the present invention may be applied to all types of toys, fittings and similar articles in addition to the makeup brush device described above as an example, if it is constructed to include the outer frame for forming an opening portion that may be opened and closed by the lid member and an internal member that may be made to slide out of and into the opening portion inside the outer frame.

In particular, when the mechanism for opening and closing the opening portion is implemented as the makeup brush device having the construction described above using FIGS. 2 and 3, it can provide the advantages that will be described below.

If any elastic element such as the spring is used for permitting the lid member 1 to open and close the opening portion 40 provided in the makeup brush device having the construction described using FIGS. 2 and 3, and as such makeup brush device is usually used by women in particular, it is not easy for any of those women to try to open the lid member 1 by pushing the brush portion 10 with her finger against the force of the elastic element such as the spring that is acting upon the lid member 1.

In the makeup brush device that is implemented by the mechanism for opening and closing the opening portion in accordance with the present invention as described above, however, the operations for opening and closing the opening portion can be performed by the simple construction in which the elastic element such as the spring is not employed. When the user such as a woman in particular uses the brush portion 10, she can open the lid member 1 by simply operating the lid member 1 gently with one hand and with one finger, and then can make the brush portion 10 to be slid out of the opening portion. When she finishes using the brush portion 10, she can also make the brush portion 10 to be slid back into the opening portion with one hand and with one finger, and can then close the lid member 1.

For the makeup brush device having the construction described using FIGS. 2 and 3, it is possible to place the makeup brush device on the dressing table in the state in which the brush portion 10 remains to be slid out of the device as shown in FIG. 2 (*c*), or while it is in use or while those makeup brush devices are displayed for sale as commercial articles.

If the elastic element such as the spring is used for permitting the lid member 1 to open and close the opening portion 10 in the case of the makeup brush device having the construction described using FIGS. 2, 3, or particularly when the elastic element such as the spring is acting upon the lid member 1 in the direction of closing the lid member 1, there is a problem in that if the brush portion 10 should remain to be slid out of the opening portion for an extended period of time, as described previously, the lid member 1 would have to be placed in its opened state against the elastic force of the elastic element such as the spring, which would weaken the elastic force of the elastic element such as the spring. There is another problem in that if the opening and closing operation of the lid member 1 is repeated during the extended period of time, the elastic element such as the spring would become unusable.

As described above, the mechanism for opening and closing the opening portion according to the present invention has the simple construction that includes the reduced number of component parts and in which there is no need of using any elastic element such as the spring. As such, the opening and closing of the lid member can be performed with stability even if it is repeated during the long term usage, and the lid member can maintain to be placed in its closed state with stability once it is closed.

What is claimed is:

1. A mechanism for opening and closing an opening portion having an outer frame and an outer wall member having an opening portion formed therein, and a lid member for operatively opening and closing the opening portion, which includes:

a rotation supporting shaft disposed on the outer side of one end of the outer wall member that faces the opening portion;

a lid member's wound section disposed on one end of the lid member and having a head end wound around the rotation supporting shaft, the one end of the lid member being supported pivotally by the rotation supporting shaft surrounded by the lid member's wound section with the other end of the lid member closing the opening portion; and an opening and closing member operated for causing the lid member to open and close the opening portion, the opening and closing member having a head end that is made to slide out of and into the opening portion inside the outer wall member on the outer frame;

when the opening portion is closed by the lid member, the head end of the lid member's wound section surrounding the rotation supporting shaft is extended inwardly of the opening portion until it reaches the point that is located closer to the inward direction of the opening portion than the point in which the rotation supporting shaft is located; and the opening and closing member has a protrusion on an outer wall thereof on the side on which the head end of the opening and closing member being made to slide out of and into the opening portion faces opposite the outer frame, the protrusion having a head end directed from an inner side toward an outer side of the outer wall member on the outer frame, wherein when the opening portion is closed by the lid member, the head end of the protrusion and the head end of the lid member's wound section are brought closer to each other, causing them to face opposite each other, and then the opening and closing member is operated so that its head end can be made to slide out of the opening portion, and can be made to engage the side of the lid member located inwardly of the opening portion, causing the one end of the lid member being supported pivotally by the rotation supporting shaft to rotate about the rotation supporting shaft and thereby permitting the opening portion to be opened; and reversely when the opening portion is to be closed from its opened state, the opening and closing member is operated so that its head end can be made to slide back into the opening portion, causing the head end of the protrusion of the opening and closing member to engage the head end of the lid member's wound section and thereby causing the one end of the lid member being supported pivotally by the rotation supporting shaft to rotate about the rotation supporting shaft.

* * * * *